US012048388B1

(12) United States Patent
Hall et al.

(10) Patent No.: US 12,048,388 B1
(45) Date of Patent: Jul. 30, 2024

(54) WOODEN SOCCER BALL TROPHY

(71) Applicants: Judy Balasa, Peoria, AZ (US); Edwin Arthur Metzger, Jr., Pensacola, FL (US)

(72) Inventors: William F. Hall, Wetumpka, AL (US); Edwin Arthur Metzger, Jr., Pensacola, FL (US)

( * ) Notice: Subject to any disclaimer, the term of this patent is extended or adjusted under 35 U.S.C. 154(b) by 0 days.

(21) Appl. No.: 17/982,465

(22) Filed: Nov. 7, 2022

Related U.S. Application Data

(60) Provisional application No. 63/276,649, filed on Nov. 7, 2021.

(51) Int. Cl.
*A47G 33/00* (2006.01)

(52) U.S. Cl.
CPC ..... *A47G 33/004* (2013.01)

(58) Field of Classification Search
CPC ..... A47G 33/004
USPC ..... 428/542.4
See application file for complete search history.

(56) References Cited

U.S. PATENT DOCUMENTS

2005/0282030 A1* 12/2005 Kennedy ..... A47G 33/004 428/542.4
2012/0052994 A1* 3/2012 Su ..... A63B 41/08 473/605

FOREIGN PATENT DOCUMENTS

CN 1092534 C 10/2002

OTHER PUBLICATIONS

Autodesk Instructables, "The Unreal Globe (literally)", Sep. 29, 2019, URL: <https://www.instructables.com/Wooden-Globe/>, pp. 1-61 (Year: 2019).*
"Wood Black Accented Soccer Ball Trophy Award," dickstrophies.com. https://dickstrophies.com/shopping-cart/catalog/display-single-product.php?CSN=0&PSN=32qsvDFXN&HATC=No&HPP=No [Date accessed: Aug. 13, 2020].
"Football model—Soccer ball—Wooden handmade—Dimension 11"," etsy.com. https://www.etsy.com/listing/723489246/football-model-soccer-ball-wooden?ga_order=most_relevant&ga_search_type=all&ga_view_type=gallery&ga_search_query=wooden+soccer+ball+model&ref=sr_gallery-1-2&organic_search_click=1&frs=1&cns=1 [Date accessed: Aug. 13, 2020].
"Soccer Ball Model : Handcrafted," shoppingzoneplus.com. https://www.shoppingzoneplus.com/engraved-wooden-soccer-ball-model-handcrafted.html#/product-description [Date accessed: Aug. 13, 2020].

* cited by examiner

*Primary Examiner* — Katherine A Christy
(74) *Attorney, Agent, or Firm* — Bold IP PLLC; Christopher Mayle

(57) ABSTRACT

A system and method for a wooden soccer ball trophy which includes a wooden soccer ball and a personalized base. The wooden soccer ball is crafted to the size, shape, and appearance of a professional soccer ball and rests upon the personalized base. In some instances, the wooden soccer ball trophy is decorated to include any type of team logo, dates, or other relevant information.

17 Claims, 6 Drawing Sheets

WOODEN SOCCER BALL TROPHY

CROSS REFERENCE TO RELATED APPLICATIONS

This application claims priority to U.S. Provisional Patent No. 63/276,649 filed on Nov. 7, 2021, which is incorporated in its entirety.

FIELD OF THE DISCLOSURE

The present invention relates generally to the field of trophy assembly and construction, and more particularly, relates to the manufacturing and production of a trophy that takes on the size, shape, and appearance of a professional soccer ball.

BACKGROUND

Presently, a trophy may include a figure or other design for an award placed upon a base of the trophy. The figure or design for an award is typically a three-dimensional model of a representative sporting element like a soccer ball, a football player, a racing shoe, or other emblem representative of a particular activity. The trophy construction can vary in structure and material. Inexpensive trophies are conventionally made with extruded and/or injection molded plastic or metal parts. A more robust trophy may be handcrafted from a solid piece of material, such as wood, wherein the wood is shaped to resemble a three-dimensional object. However, this process is time consuming and wasteful. The crafting process requires a large amount of starting material resulting in an abundance of remnant material. Lacking from present options for making trophies is the ability to make a wooden trophy having a three-dimensional sporting element such as soccer ball, crafted to meet precise specifications while requiring minimal construction material.

Accordingly, the need still exists for the method in which to craft a wooden soccer ball to the size, shape, and appearance of a professional soccer ball, whereby the soccer ball is comprised of a wooden skeleton frame upon which wooden strips are placed over the wooden skeleton frame.

DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DESCRIPTION OF THE DRAWINGS

In the summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises," and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components. The term "set" as used herein may refer to one or more items.

The following description provides preferred exemplary embodiments only, and is not intended to limit the scope, applicability, or configuration of the invention. The following description of the preferred exemplary embodiment will provide those skilled in the art with an enabling description for implementing a preferred exemplary embodiment of the invention. It being understood that various changes may be made in the function and arrangement of elements without departing from the scope of the invention as set forth in the claims.

The present description includes one or more non-limiting embodiments for a wooden soccer ball trophy. In one or more non-limiting embodiments, the presently disclosed invention includes a wooden soccer ball and a personalized base. The wooden soccer ball is crafted to the size, shape, and appearance of a professional soccer ball and rests upon the personalized base. In some instances, the wooden soccer ball trophy is decorated to include any type of team logo, dates, or other relevant information.

Figure 1:
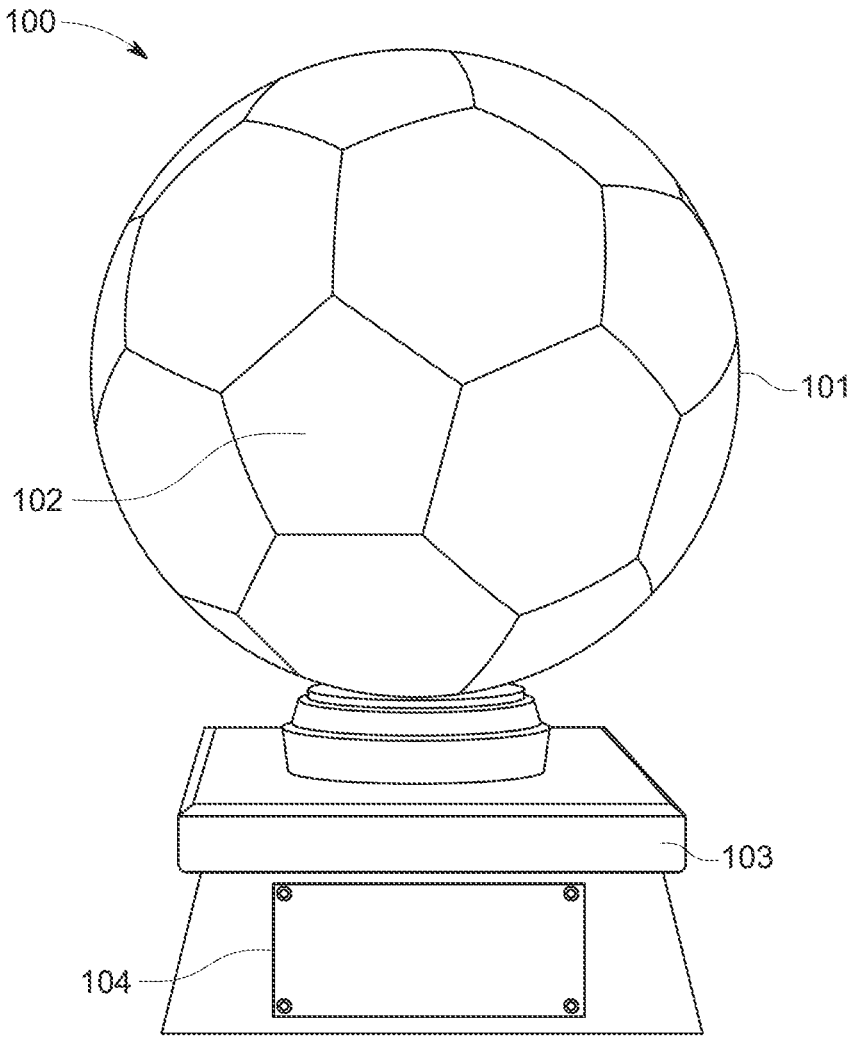
FIG. 1 is a front view of an exemplary embodiment of a wooden soccer ball trophy in accordance with an illustrative embodiment.

Referring now to FIG. 1, FIG. 1 is a physical embodiment of an exemplary wooden soccer ball trophy in accordance with a non-limiting embodiment. FIG. 1 shows an example of a wooden soccer ball trophy 100. The wooden soccer ball trophy includes a wooden soccer ball 101 crafted to the size, shape, and appearance of a professional soccer ball. In one or more non-limiting embodiments, the wooden soccer ball 101 is comprised of a wooden skeleton frame (not shown). The wooden skeleton frame provides the internal structure for the wooden soccer ball 101, whereby the size of the wooden skeleton frame corresponds to the internal size of a professional soccer ball. In one or more non-limiting embodiments, the wooden skeleton frame is made from a flexible plywood material that is designed for making curved parts. Alternatively, the wooden skeleton frame may include any other flexible wood material other than or in addition to plywood.

Figure 2:
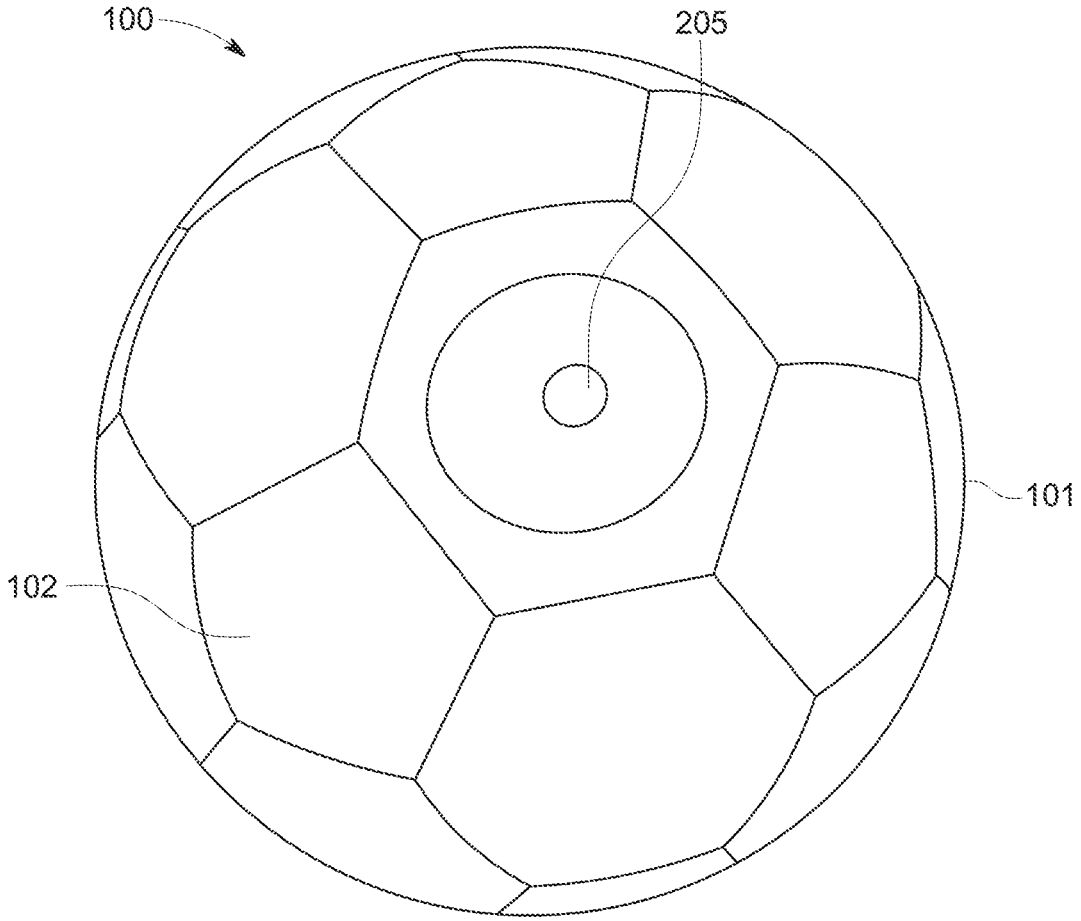
FIG. 2 is a top view of an exemplary embodiment of a wooden soccer ball trophy in accordance with an illustrative embodiment.

In one or more non-limiting embodiments, the wooden skeleton frame may include at least four wooden discs made of flexible plywood material. The wooden discs may have an outer circumference reflecting the inner circumference of a professional soccer ball. The wooden discs may be concentrically placed and aligned with a central dowel pin 205 as shown in FIG. 2. The central dowel pin 205, as shown in FIG. 2, is centrally located on a top surface of the wooden soccer ball 101. To form the wooden soccer ball trophy 100, a first wooden disc may be positioned having its diameter aligned with the central dowel pin 205. The central dowel pin 205 may be inserted through the first wooden disc and may be aligned with the diameter of the first wooden disc. A second wooden disc is centrally aligned with the central dowel pin 205. The second wooden disc is positioned having its diameter located 90 degrees to the central dowel pin 205. When assembled, the second wooden disc may overlap the first wooden disc. The remaining wooden discs are centrally aligned with the central dowel pin 205 and overlap each other as well as the first and second wooden discs. Together, the outer circumference of the combined overlapping concentric wooden discs form a hollow sphere sized to reflect the inner circumference of a professional soccer ball and thus form the wooden skeleton frame.

Returning now to FIG. 1, wooden strips 102 are attached to the wooden skeleton frame forming an outer shell. At least 28 wooden strips are utilized to form the wooden soccer ball 101 giving it the size and shape of a professional soccer ball. In one or more non-limiting embodiments, the wooden strips 102 are attached using a glue adhesive. Alternatively, the wooden strips 102 may be attached using an any other means of attachment. In one or more non-limiting embodiments, the wooden strips 102 may be a flexible plywood material that is designed for making curved parts. Alternatively, the wooden strips may include any other flexible wood material other than or in addition to plywood. The wooden strips 102 may be long wooden strips as shown in FIG. 1. The etchings made over the wooden strips 102 may create pentagon shapes as shown in FIG. 1 in one or more non-limiting embodiments in order to give the wooden soccer ball 101 the appearance of a traditional soccer ball.

In one or more non-limiting embodiments, the wooden soccer ball 101 is given the appearance of a professional soccer ball whereby details associated with a professional soccer ball may be added to the wooden soccer ball 101 on the trophy 100. For instance, a traditional soccer ball pattern comprised of pentagons as shown in FIG. 1 may be etched into the outer surface of the wooden soccer ball 101 giving the wooden soccer ball 101 the overall appearance of a professional soccer ball.

In one or more non-limiting embodiments, the wooden soccer ball 101 rests upon a base 103. The base 103 may be made of wood and crafted such that the wooden soccer ball 101 can be displayed when placed upon the base 103. The base 103 may be personalized such that a plaque, nameplate, or other similar inscribed plate 104 is attached to the base 103. The wooden soccer ball trophy 100 may thus be a combination of the wooden soccer ball 101 and the base 103. Additionally, in one or more non-limiting embodiments, the wooden soccer ball trophy 100 is decorated to include any type of team logo, dates, or other relevant information for the recipient of the wooden soccer ball trophy 100.

Referring now to FIG. 2, FIG. 2 provides a top view of the wooden soccer ball trophy 100. The wooden soccer ball trophy includes the wooden soccer ball 101. As noted above, the wooden soccer ball 101 is formed by attaching the wooden strips 102 to the wooden skeleton frame (forming an outer shell). The wooden skeleton frame may act as an internal structure for the wooden soccer ball 101, whereby the size of the skeleton frame corresponds to the internal circumference of a professional soccer ball. In one or more non-limiting embodiments, at least 28 wooden strips are utilized to form the outer shell which forms the wooden soccer ball 101, whereby the wooden soccer ball 101 has the size and shape of a professional soccer ball. The wooden soccer ball 101 has the appearance of a professional soccer ball, whereby details typically associated with a traditional soccer ball pattern are etched or otherwise included on the outer surface of the wooden soccer ball 101.

Figure 3:
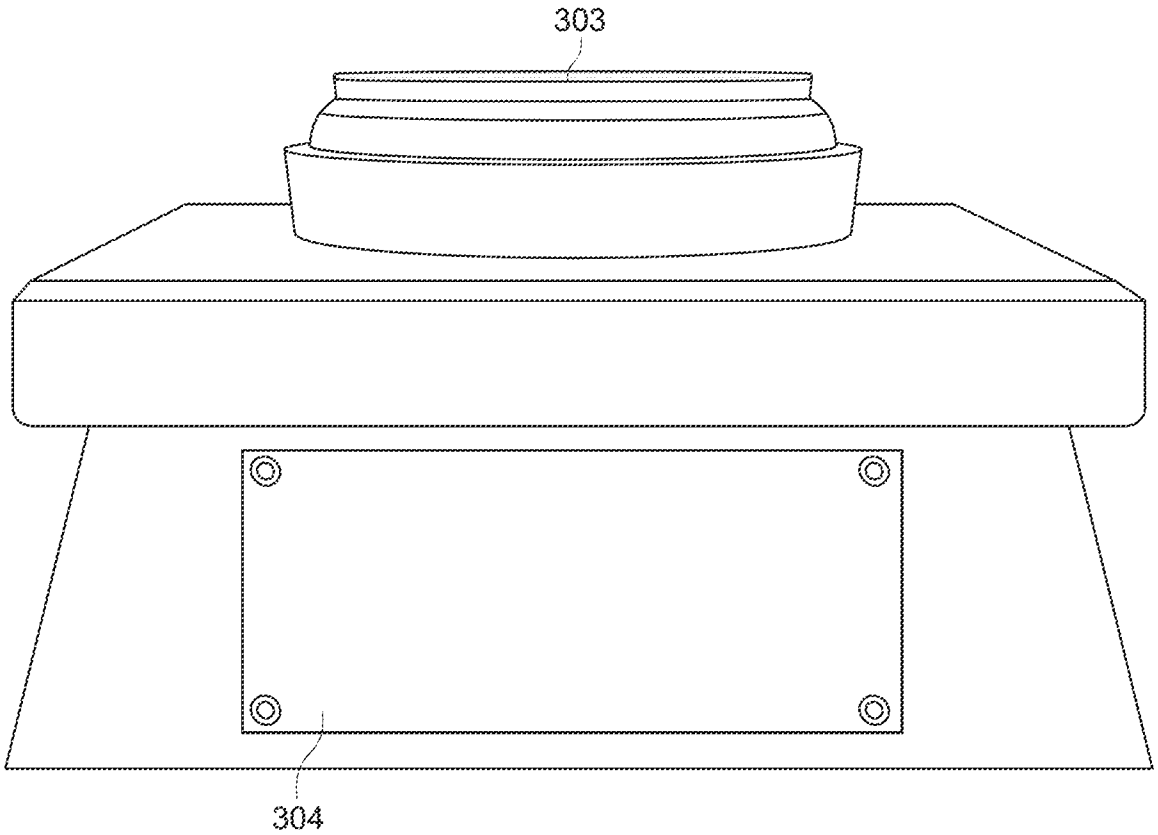
FIG. 3 is a front view of an exemplary embodiment of a wooden soccer ball trophy in accordance with an illustrative embodiment.

Referring now to FIG. 3, FIG. 3 provides a front view of the base 303 of the wooden soccer ball trophy 100 upon which the wooden soccer ball 101 rests. The base 303 may be made of wood and crafted such that the wooden soccer ball 101 can rest upon the base 303 when placed upon the base 303. The base 303 is configured to display and support the wooden soccer ball 101. The base 303 may be personalized with a plaque, nameplate, or other similar inscribed plate 304 that may be attached to the base 303.

Figure 4:
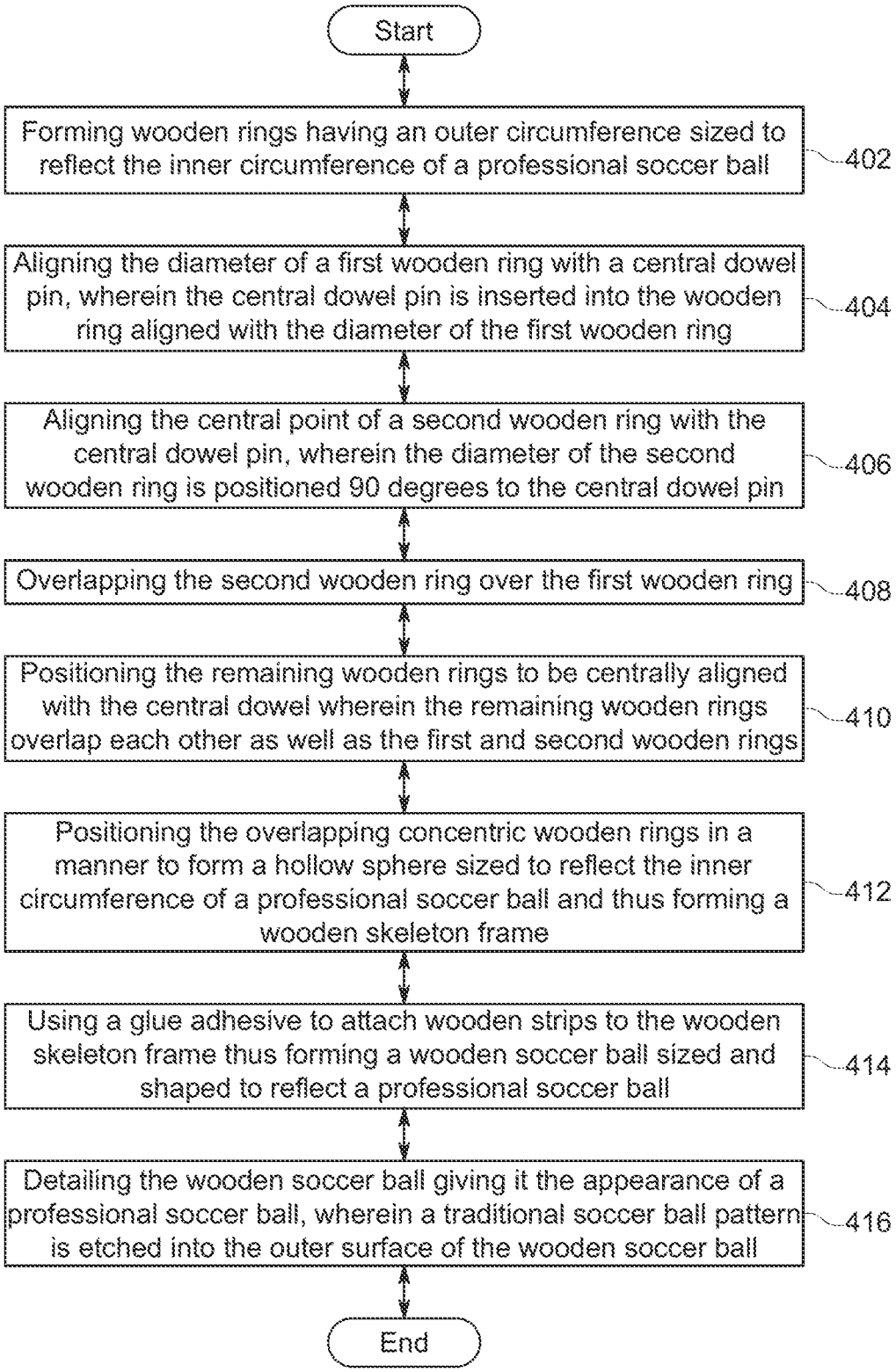
FIG. 4 is a flowchart of an exemplary method for crafting a wooden soccer ball in accordance with an illustrative embodiment.

Turning to FIG. 4, FIG. 4 is a flowchart of an exemplary method for crafting and designing a wooden soccer ball 101 for a wooden soccer ball trophy 100. In one or more non-limiting embodiments, the process may begin at step 402 by forming wooden discs having an outer circumference sized to reflect the inner circumference of a professional soccer ball. At step 404, the method may continue by aligning the diameter of a first wooden disc with a central dowel pin 205, whereby the central dowel pin 205 may be inserted through the first wooden disc to be aligned with the diameter of the first wooden disc. At step 406, the method may continue by aligning the central point of a second wooden disc with the central dowel pin 205, whereby the diameter of the second wooden disc is positioned 90 degrees to the central dowel pin 205.

At step 408, the process may continue by overlapping the second wooden disc over the first wooden disc. At step 410, the remaining wooden discs are positioned so as to be centrally aligned with the central dowel pin 205 whereby the remaining wooden discs overlap each other as well as the first and second wooden discs. At step 412, the overlapping concentric wooden discs are positioned in a manner to form a hollow sphere sized to reflect the inner circumference of a professional soccer ball and thus forming a wooden skeleton frame.

At step 414, the process may continue by using a glue adhesive to attach wooden strips to the wooden skeleton frame thus forming a wooden soccer ball 101 sized and shaped to reflect a professional soccer ball. At step 416, the process calls for detailing the wooden soccer ball 101 to give the wooden soccer ball 101 the appearance of a professional soccer ball, whereby a traditional soccer ball pattern is etched into the outer surface of the wooden soccer ball 101.

Figure 6:
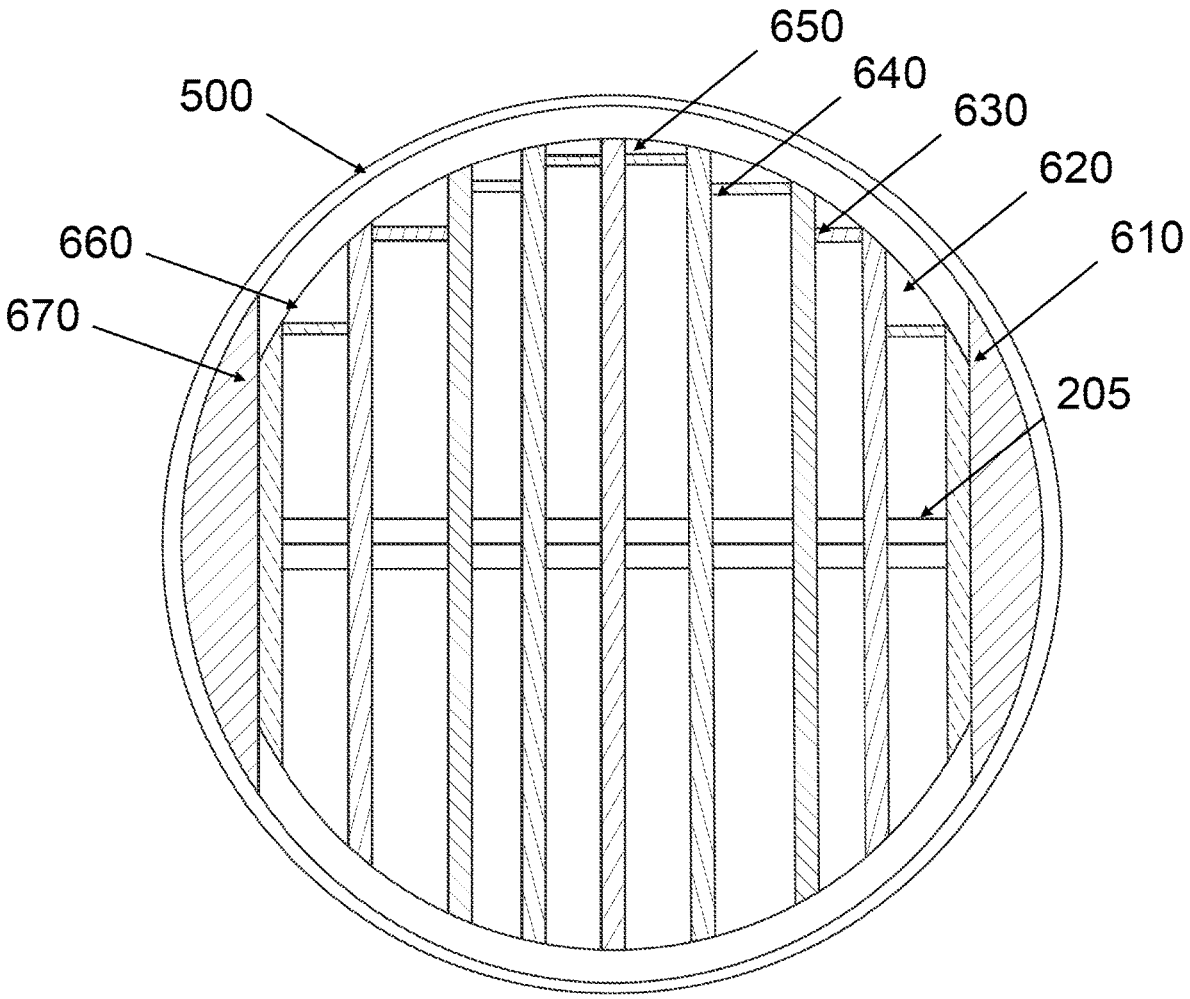
FIG. 6 is a side view of the inside of the wooden soccer ball trophy in accordance with an illustrative embodiment.

In one non-limiting embodiment, the finished circumference of wooden soccer ball 101 may be 29.5 inches as illustrated in FIG. 6. The discs may be ⅕ inches width and have varying diameter. The outer discs 610 may be 4 and 5/16 inches diameter angled at 67 degrees, the second outer discs 620 may be 6 and 15/16 inches diameter 45 degrees, the third outer discs 630 may be 7 and 13/16 inches diameter 30 degrees, the fourth outer discs 640 may be 8 and 13/16 inches diameter 20 degrees, and the inner disc 650 may be 9 and ⅛ inches diameter 90 degrees. Solid end caps 670 positioned at the horizontal ends may be 4 and ¼" diameter×⅜ inch thickness. Central dowel pin 205 may be ½" diameter and 9 and ⅝ inch length. Spacers 660 positioned between the discs may be ⅛ inch thickness and 11/16 inch width and have different lengths corresponding to the distances. The distance between the fourth outer discs 640 and the third outer discs 630 may be the greatest at 1 inch. The distance between the outer discs 610 and the second outer discs 620 may be ½ inches. The distance between the second outer discs 620 and the third outer discs 630 may be ¾ inches. The distance between the fourth outer discs 640 and the inner disc 650 may be 1 and 1/16 inch distance.

In another embodiment, the discs may be ¼ inches width and have varying diameter. The outer discs may be 3 and ⅛ inches diameter 67 degrees, the second outer discs may be 5 and 15/16 inches diameter 30 degrees, the third outer discs 30 may be 7 and 9/16 inches diameter 20 degrees, and the inner disc may be 3 and 3/16 inches diameter 90 degrees. Solid end caps 670 positioned at the horizontal ends may be 3 inches diameter×3/16 inches thickness. Central dowel pin 205 may be ½" diameter and 6 and ⅝ inch length. The spacers 660 positioned between the discs may be ⅛ inch thickness and 11/16 inch width and have different lengths corresponding to the distances. The distance between the outer discs and the second outer discs may be ⅞ inches. The distance between the second outer discs and the third outer discs may be 1 and 1/16 inches. The distance between the third outer discs and the center disc may be 1 and ¼ inch distance.

Figure 5:
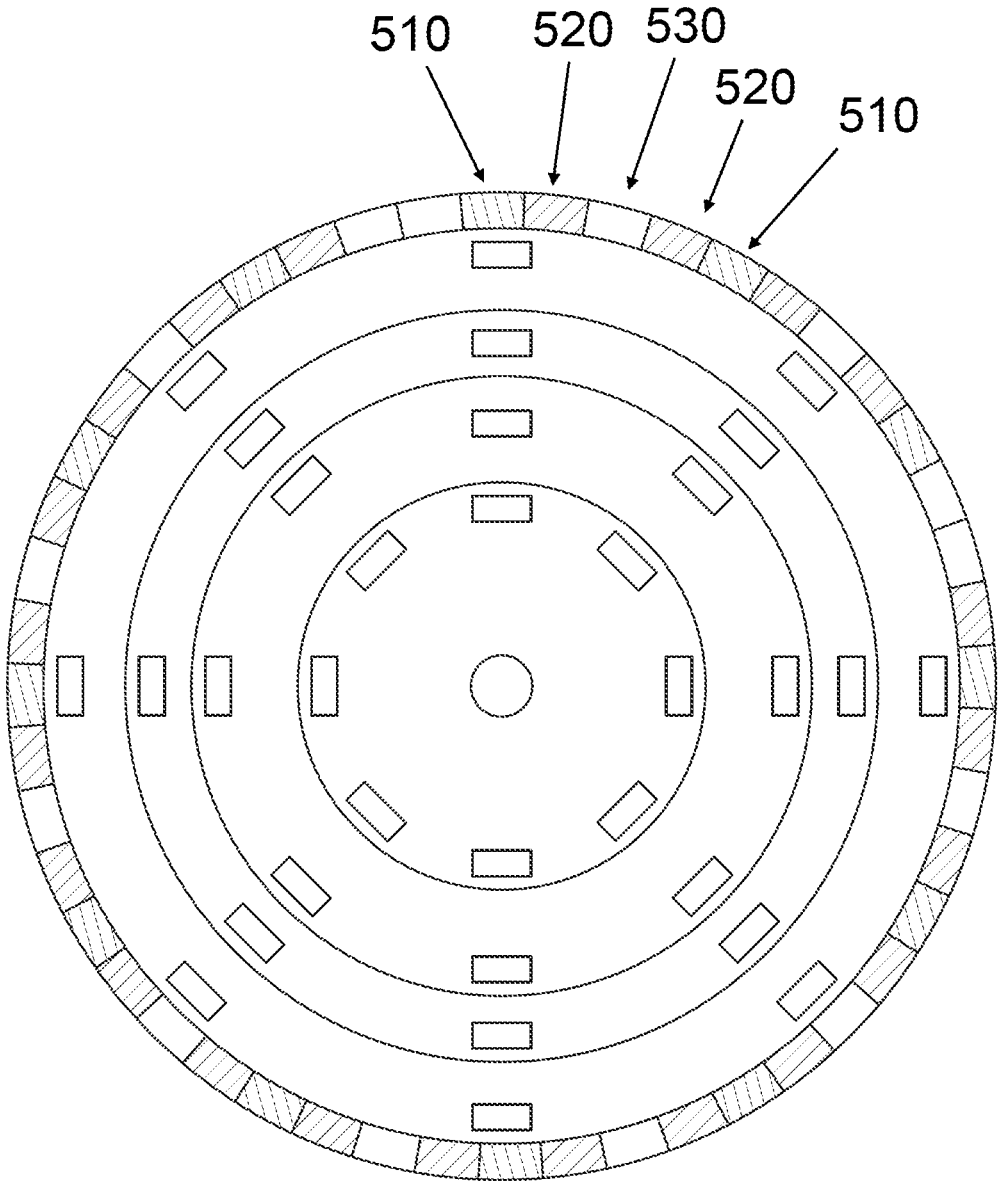
FIG. 5 is an end view of the inside of the wooden soccer ball trophy in accordance with an illustrative embodiment.

The outer sticks 500 that make up the exterior surface as illustrated in FIG. 5 may have sticks that alternate in a 1 2 3 2 1 2 3 2 1 pattern around the circle starting at the top whereby the corresponding 1 stick (510) is ⅛ by 9/16 by 11 inches, the corresponding 2 stick (520) is ⅛ by ½ by 9 and ¼ inches, the corresponding 3 stick (530) is ⅛ by 9/16 by 11 inches.

Many advantages and benefits are offered by the wooden soccer ball trophy as described herein in one or more non-limiting embodiments. The wooden soccer ball trophy may be commemorative memorabilia. Further, the wooden soccer ball trophy 100 is formed to include a wooden soccer ball 101 that is crafted to match the size, shape, and appearance of a professional soccer ball without complex wooden carving or manufacturing.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed.

Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed:

1. A wooden soccer ball trophy comprising:

a wooden soccer ball crafted to a size, shape, and appearance of a professional soccer ball, wherein the wooden soccer ball is comprised of a skeleton frame having a plurality of discs that are concentrically aligned with a central dowel pin, wherein an outer circumference of the plurality of discs form a hollow sphere sized to reflect an inner circumference of a soccer ball; and a base on which the wooden soccer ball rests.

2. The wooden soccer ball trophy of claim 1, wherein the skeleton frame is made of a flexible plywood material.

3. The wooden soccer ball trophy of claim 1, wherein a first wooden disc is positioned having a diameter aligned with the central dowel pin, wherein the central dowel pin is inserted through the first wooden disc, wherein a second wooden disc is centrally aligned with the central dowel pin, wherein the second wooden disc is positioned having a diameter positioned 90 degrees to the central dowel pin wherein the second wooden disc overlap the first wooden disc.

4. The wooden soccer ball trophy of claim 3, wherein third wooden discs are centrally aligned with the central dowel pin and overlap each other as well as the first wooden disc and the second wooden disc.

5. The wooden soccer ball trophy of claim 3, further comprising wooden strips attached to the skeleton frame forming an outer shell.

6. The wooden soccer ball trophy of claim 5, wherein one or more pentagonal shaped etchings are positioned on the wooden strips.

7. The wooden soccer ball trophy of claim 6, wherein there are 28 of the wooden strips.

8. The wooden soccer ball trophy of claim 7, wherein the central dowel pin is completely contained within an interior of the wooden soccer ball.

9. The wooden soccer ball trophy of claim 6, wherein the wooden strips are positioned in a sequential order with a first type in first, a second type in second, a third type in third, the second type in fourth, the first type in fifth, the second type in sixth, the third type in seventh, the second type in eighth, and the first type in ninth.

10. The wooden soccer ball trophy of claim 9, wherein in the first type the wooden strips are ⅛ by 9/16 by 11 inches.

11. The wooden soccer ball trophy of claim 10, wherein in the second type the wooden strips are ⅛ by ½ by 9 and ¼ inches.

12. The wooden soccer ball trophy of claim 11, wherein in the third type the wooden strips are ⅛ by 9/16 by 11 inches.

13. The wooden soccer ball trophy of claim 4, wherein the plurality of discs are ⅕ inches width and have varying diameter.

14. The wooden soccer ball trophy of claim 13, wherein outer discs are 4 and 5/16 inches diameter 67 degrees, wherein second outer discs are 6 and 15/16 inches diameter 45 degrees, wherein third outer discs are 7 and 13/16 inches diameter 30 degrees, wherein fourth outer discs are 8 and 13/16 inches diameter 20 degrees, and an inner disc is 9 and ⅛ inches diameter 90 degrees.

15. The wooden soccer ball trophy of claim 14, further comprising: solid end caps positioned at horizontal ends of the wooden soccer ball that are 4 and ¼" diameter×⅜ inch thickness.

16. A wooden soccer ball trophy comprising:

a wooden soccer ball crafted to a size, shape, and appearance of a professional soccer ball, wherein the wooden soccer ball is comprised of a skeleton frame having a plurality of discs that are concentrically aligned with a central dowel pin wherein spacers are positioned between the plurality of discs, wherein the wooden soccer ball has wooden strips placed over the skeleton frame, wherein the wooden soccer ball has horizontal end caps positioned at opposite ends of the skeleton frame between the skeleton frame and the wooden strips wherein the central dowel pin rests between the horizontal end caps.

17. A wooden soccer ball trophy comprising:

a wooden soccer ball crafted to a size, shape, and appearance of a professional ball, wherein the wooden soccer ball is comprised of a skeleton frame having a plurality of discs that are concentrically aligned with a central dowel pin that is completely contained within the wooden soccer ball, wherein a first wooden disc is positioned having a diameter aligned with the central dowel pin, wherein the central dowel pin is inserted through the first wooden disc, wherein a second wooden disc is centrally aligned with the central dowel pin, wherein one or more third discs overlap the first wooden disc, wherein a circumference of a combined overlapping concentric wooden disc form a hollow sphere sized to reflect an inner circumference of the professional ball and form the skeleton frame.

* * * * *